US008016571B2

(12) United States Patent
Speer et al.

(10) Patent No.: US 8,016,571 B2
(45) Date of Patent: Sep. 13, 2011

(54) THRUST AND INTAKE CHAMBER FOR PUMP

(75) Inventors: Gary W. Speer, Claremore, OK (US); Terry W. Shafer, Broken Arrow, OK (US); Mark C. James, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 1004 days.

(21) Appl. No.: 11/833,069

(22) Filed: Aug. 2, 2007

(65) Prior Publication Data

US 2009/0035159 A1 Feb. 5, 2009

(51) Int. Cl.
*F04B 35/00* (2006.01)

(52) U.S. Cl. ..... 417/365; 417/423.6; 417/423.13; 417/423.12; 384/420

(58) Field of Classification Search ..... 417/365, 417/423.6, 423.12, 423.13; 384/420
See application file for complete search history.

(56) References Cited

U.S. PATENT DOCUMENTS

| | | | | | |
|---|---|---|---|---|---|
| 3,652,186 | A | * | 3/1972 | Carter | 417/370 |
| 4,812,108 | A | * | 3/1989 | Kotera | 417/368 |
| 5,160,246 | A | * | 11/1992 | Horiuchi | 417/365 |
| 5,340,273 | A | | 8/1994 | Rockwood | |
| 5,674,057 | A | * | 10/1997 | Guardiani et al. | 417/423.3 |
| 5,779,434 | A | * | 7/1998 | De Long | 415/104 |
| 5,957,656 | A | | 9/1999 | DeLong | |
| 6,461,115 | B1 | | 10/2002 | Ferrier | |
| 2002/0102169 | A1 | * | 8/2002 | Wampler | 417/420 |
| 2003/0219347 | A1 | | 11/2003 | Mascola | |

OTHER PUBLICATIONS

Search Report for related application PCT/US2008/072052, dated Feb. 11, 2009.

*Horizontal Surface Pumping System*, Baker Hughes Centrilift, Data Sheet HZ1.

* cited by examiner

*Primary Examiner* — Charles G Freay
*Assistant Examiner* — Todd D Jacobs
(74) *Attorney, Agent, or Firm* — Bracewell & Giuliani LLP

(57) ABSTRACT

A pump end assembly has a centrifugal pump and a motor separated by a chamber. The chamber contains a thrust bearing as well as an intake for the pump. Fluid flowing into the intake flows through the thrust chamber and to the inlet of the pump. Some of the fluid also flows through the thrust bearing for lubricating the thrust bearing.

9 Claims, 2 Drawing Sheets

THRUST AND INTAKE CHAMBER FOR PUMP

FIELD OF THE INVENTION

This invention relates in general to centrifugal pumps and in particular to a thrust bearing and intake chamber for a surface mounted centrifugal pump.

BACKGROUND OF THE INVENTION

Electrical submersible pumps are commonly used in oil wells for pumping large volumes of fluids. The pump is centrifugal, having a large number of stages of impellers and diffusers. An electrical motor is attached to the pump for driving the pump.

This type of pump is also used for various surface applications, such as for injecting a fluid into the well. In the surface application, the pump is mounted on a skid. An intake chamber is mounted to the intake end of the pump. A thrust chamber having a thrust bearing located therein is mounted to the intake chamber. The electrical motor is mounted to the skid independently of the pump. The shaft of the electrical motor couples to the shaft extending through the thrust chamber.

The typical prior art surface pumps of this type utilize a thrust chamber that is filled with a clean lubricating oil for lubricating the thrust bearing. The working fluid being pumped, typically water, does not enter the thrust portion of the thrust chamber containing the lubricant. While this type of pump works well, the seal between the lubricant and the working fluid in the intake chamber must be replaced from time to time due to wear. This can be a difficult task because it requires removal of the entire thrust bearing assembly from the pump assembly. During removal time, the pump will be shut down and cannot be operated.

U.S. Pat. No. 5,957,656 discloses a surface mounted pump with a thrust chamber that utilizes a filtered portion of the working fluid for lubricating the bearings, rather than a clean lubricant. The thrust chamber mounts to the intake chamber. A line extends from the working fluid intake extends to a separator or filter, and from there to a small pump stage for pumping filtered fluid through the thrust chamber bearings. The filtered fluid then re-enters the intake chamber.

SUMMARY OF THE INVENTION

In this invention, the thrust chamber connects directly to the housing of the pump. The working fluid intake is mounted to a sidewall of the thrust chamber, rather than to a separate intake chamber. The fluid flows into the thrust chamber and from there into the pump. The fluid also lubricates the thrust bearings. In the preferred embodiment, the fluid is not filtered prior to passing through the thrust bearings. Also, the flow path through the thrust bearings is arranged so that no pump stage is needed to pump the fluid through the thrust bearing.

DETAILED DESCRIPTION OF THE INVENTION

Figure 1:
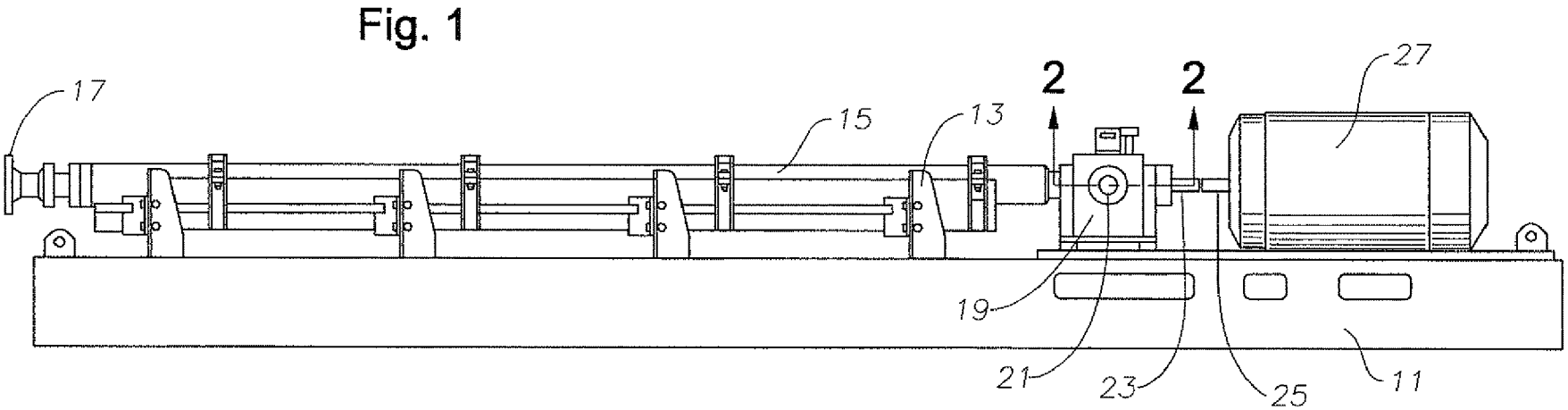
FIG. 1 illustrates a surface mounted pump assembly constructed in accordance with this invention.

Referring to FIG. 1, the surface mounted pump assembly includes a skid 11 that is normally horizontally supported on a pad on the surface. Skid 11 has a cradle 13 on its upper side that supports a centrifugal pump 15 horizontally. Pump 15 has a large number of stages, each stage comprising a rotating impeller and a stationary diffuser. Pump 15 has a discharge 17 on one end for connection to a flowline.

A thrust chamber 19 is mounted on skid 11 at the end opposite discharge 17. Thrust chamber 19 has a thrust bearing assembly 20 (FIG. 2) mounted therein for absorbing thrust generated by pump 15. Thrust chamber 19 also has an intake 21 for connecting to a flowline to supply working fluid to pump 15. A chamber shaft 23 extends through thrust chamber 19. Chamber shaft 23 is coupled on one end to motor shaft 25 for driving pump 15. Motor shaft 25 is rotated by a motor 27, which is independently mounted to skid 11.

Figure 2:
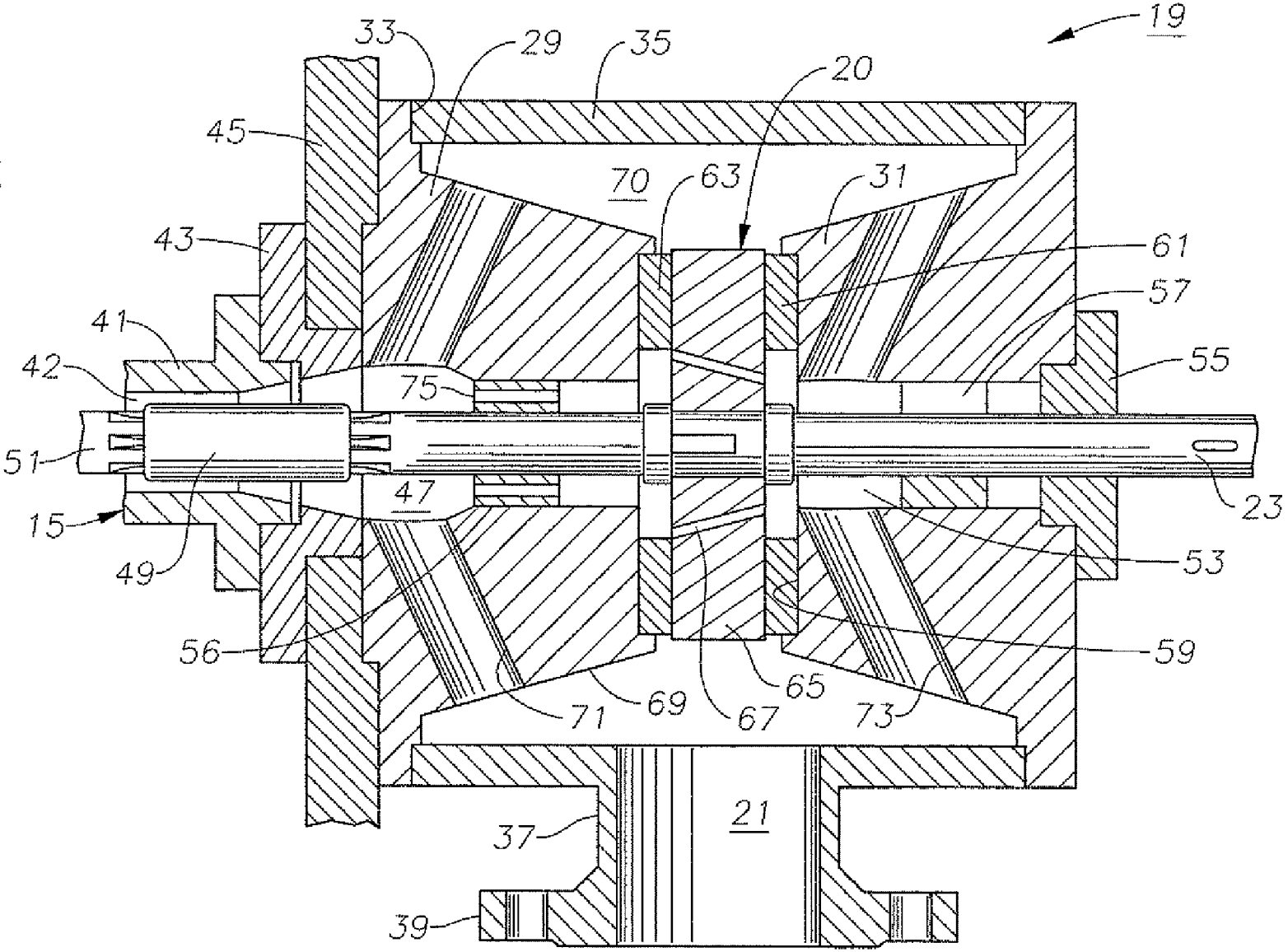
FIG. 2 is a sectional view of the thrust chamber of the assembly of FIG. 1, taken along the line 2-2 of FIG. 1.

Referring to FIG. 2, thrust chamber 19 has a pump end member 29 and a motor end member 31. Each end member 29, 31 has a circular external flange 33. A tubular housing or sidewall 35 surrounds end members 29, 31 and connects to flanges 33 of end members 29, 31. Cylindrical sidewall 35 could be connected in other ways, such as by threads, rather than by bolts extending through flanges 33 schematically illustrated.

Intake 21 comprises a tubular member 37 that extends outward from sidewall 35 relative to a longitudinal axis of shaft 23. Tubular member 37 has a connector on its outer end for connecting to a flowline. In this embodiment, the connector comprises a flange 39 for bolting to a flowline. Other types of connectors are feasible. In this example, an axis of intake 21 intersects the longitudinal axis of shaft 23 at 90 degrees, thus comprises a radial line of the axis of shaft 23; however the angle of intersection may vary. Also, the axis of intake 21 intersects a mid-center portion of thrust hearing 20 in this embodiment, thus intake 21 is located radially outward from thrust bearing 20.

A base portion 41 of the housing of pump 15 bolts directly to thrust chamber 19. Pump base 41 is illustrated as bolting to an adapter 43, which in turn bolts to an end plate 45 of thrust chamber 19. Other arrangements for connecting the housing of pump 15 to thrust chamber 19 are feasible. For example, end plate 45 and adapter 43 may be eliminated in some circumstances.

Pump end member 29 has an axial passage 47 extending through it through which shaft 23 passes. Axial passage 47 includes mating axial passages in end plate 45, adapter 43 and pump base 41. Axial passage 47 is larger in diameter than the outer diameter of shaft 23, providing an annular inlet 42 for pump 15. A coupling 49 is shown connecting the splines of chamber shaft 23 to pump shaft 51 for rotating pump shaft 51.

Motor end member 31 also has an axial passage 53 extending through it that is coaxial with passage 47. Axial passage 53 has a seal 55 on its motor end for sealing around shaft 23. Seal 55 is shown schematically and may be a variety of types. Preferably it would be a type having a rotating component that rotates against a stationary base, the rotating component being urged by a coil spring against the stationary base. Radial bearings or bushings 56, 57 are located within axial passages 47, 53, respectively, for providing radial support for chamber shaft 23.

Each end member 29 and 31 has an end face 59, the end faces 59 being opposed to each other and spaced apart from each other along the axis of shaft 23. A thrust bearing stationary base 61 is affixed to end face 59 of motor end member 31 for absorbing thrust passing in a direction from pump 15 toward thrust chamber 19. Pump 15 in some circumstances may exert thrust in the opposite direction. Preferably to accommodate this type of thrust, a stationary thrust bearing face 63 is affixed to end face 59 on pump end member 29.

Thrust bearing 20 also has a thrust runner 65 that is secured to shaft 23 for rotational as well as axial movement. Thrust runner 65 is sandwiched between stationary bases 61 and 63 to transfer thrust imposed on shaft 23 to one of the bases 61 or 63. Thrust runner 65 preferably has a plurality of ports 67 extending from its motor side to its pump side for allowing fluid flow between axial passage 53 and axial passage 47 to lubricate thrust bearing 20.

Each end member 29, 31 of thrust chamber 19 has an outer portion 69 that is surrounded by sidewall 35. In this example, outer portion 69 is conical, tapering to a smaller diameter at thrust bearing 20. Other configurations are feasible. An annular clearance 70 is defined between outer portions 69 and sidewall 35.

At least one, and preferably several, pump end member ports 71 extend from outer portion 69 of pump end member 29 to passage 47. Ports 71 are inclined slightly toward pump 15 rather than being straight radial passages in this embodiment. Ports 71 provide a flow path from intake 21 through clearance 70 and axial passage 47 to pump inlet 42.

A plurality of motor end ports 73 extend from outer portion 69 of motor end member 31 inwardly to axial passage 53. Ports 73 also may incline toward pump 15 as illustrated, although other arrangements are feasible. Ports 73 provide a flow path for some of the fluid flowing through intake 21 and clearance 70 to axial passage 53 and ports 67. Bushing 56 does not seal nor significantly impede the flow of fluid flowing through thrust bearing 20 toward pump inlet 42. Ports 75 may be located in bushing 56 to assure that the flow of fluid through thrust bearing 20 is not impeded by bushing 56. In addition, ports may be located in bushing 57 to communicate the working fluid in passage 53 with seal 55.

In operation, when motor 27 (FIG. 1) is supplied with power, it rotates chamber shaft 23, which transfers rotary motion to pump shaft 51. Fluid is supplied to intake 21, immersing thrust bearing 20 in the working fluid. A portion of the fluid flows along a flow path from intake 21 through clearance 70, ports 71, passage 47 and into pump inlet 42. Another portion of the fluid flows from clearance 70 through ports 73 and passages 53, 67 and 75, where it rejoins the first flow path within passage 47. As the fluid flows through ports 67, it cools and lubricates thrust bearing 20.

The invention has significant advantages. Locating the intake in a side of the thrust chamber, rather than in a separate chamber, eliminates the need for a shaft seal sealing between the working fluid and lubricant in the thrust chamber. The fluid being pumped will provide cooling and lubrication of the thrust bearings without creating excessive wear. With thrust bearings as shown, the fluid does not need to be filtered before it passes through the thrust bearing. The incoming fluid directly impinges on the exterior of the thrust bearing and needs no supplemental pump stage to deliver the fluid through the thrust bearing.

While the invention has been shown in only one of its forms, it should be apparent to those skilled in the art that it is not so limited but is susceptible to various changes without departing from the scope of the invention.

The invention claimed is:

1. An apparatus for mounting between a centrifugal pump and an electrical motor to provide an intake for the pump and absorb thrust created by the pump, comprising:

a thrust chamber for connection between the pump and the motor, the thrust chamber having a chamber shaft extending along a longitudinal axis and a thrust bearing;

an intake port in the chamber for delivering fluid to the pump and to the thrust bearing for lubricating the thrust bearing; and wherein a radial line emanating from the longitudinal axis and passing through the thrust bearing also passes through the intake port;

wherein the thrust chamber comprises:

a pump end member, a motor end member, and a tubular sidewall located between and connected to the pump end member and to the motor end member, the intake port being formed in the sidewall;

the thrust bearing having a stationary base surrounded by the tubular sidewall and mounted on a face of the motor end member;

the motor end member having an outer surface portion surrounded by the sidewall;

an axially extending passage in the motor end member through which the chamber shaft extends; and a port extending from the outer surface portion of the motor end member to the passage in the motor end member for delivering fluid to the thrust bearing.

2. An apparatus for mounting between a centrifugal pump and an electrical motor to provide an intake for the pump and absorb thrust created by the pump, comprising:

a thrust chamber for connection between the pump and the motor, the thrust chamber having a chamber shaft extending along a longitudinal axis and a thrust bearing;

an intake port in the chamber for delivering fluid to the pump and to the thrust bearing for lubricating the thrust bearing; and wherein a radial line emanating from the longitudinal axis and passing through the thrust bearing also passes through the intake port;

wherein the thrust chamber comprises:

a pump end member, a motor end member, and a tubular sidewall located between and connected to the pump end member and the motor end member, the thrust bearing being surrounded by the sidewall between opposed faces of the pump end member and the motor end member, the intake port being formed in the sidewall;

the pump end member and the motor end member each having an outer portion surrounded by the sidewall and spaced inwardly to define an annular clearance that is in fluid communication with the intake port;

the pump end member having a passage for delivering the fluid from the intake port to the pump;

the motor end member having an axial passage surrounding the chamber shaft and a seal for sealing around the chamber shaft;

a motor end member port extending from the outer portion of the motor end member to the passage in the motor end member at a point between the seal and the thrust bearing to deliver fluid from the clearance to the thrust bearing; and a pump end member port extending from the outer portion of the pump end member to the passage in the pump end member to deliver fluid from the clearance to the pump.

3. An apparatus for mounting between a centrifugal pump and an electrical motor to provide an intake for the pump and absorb thrust created by the pump, comprising:

a chamber having a pump end member for mounting to a housing of the pump and a motor end member for facing the motor, the pump end member and the motor end member of the chamber each having a passage formed therein;

an annular stationary thrust bearing base mounted in the chamber in coaxial alignment with the passages;

a chamber shaft extending through the thrust bearing base, the chamber shaft having a pump end extending into the passage in the pump end member of the chamber for coupling to a pump shaft of the pump and a motor end extending sealingly through the passage in the motor end member of the chamber for coupling to a motor shaft of the motor;

the passage in the pump end member of the chamber being larger in diameter than the chamber shaft to define an annular inlet to the pump;

a thrust runner mounted to the chamber shaft in sliding engagement with the thrust bearing base for absorbing thrust applied by the pump shaft to the chamber shaft, the thrust runner having a thrust runner port extending therethrough in communication with the passage in the pump end member;

the chamber having a tubular sidewall connected between and to the pump end member and the motor end member and extending around the thrust runner, the sidewall having an interior surface spaced from the thrust runner, defining an annular clearance; and an intake port formed in the sidewall between the pump end member and the motor end member in communication with the clearance for connection to a source of fluid to flow into the chamber to the inlet in the pump;

a pump end port in the pump end member extending between the clearance and the passage in the pump end member to deliver fluid to the inlet of the pump; and a motor end port in the motor end member extending between the clearance and the passage in the motor end member to deliver fluid to the thrust runner and through the thrust runner port to the passage in the pump end.

4. The apparatus according to claim 3, wherein a radial line emanating from the chamber shaft and passing through the thrust runner passes through the intake port in the sidewall.

5. The apparatus according to claim 3, wherein the intake port comprises:

a tubular member extending outward from the sidewall of the chamber; and a connection member on an outer end of the tubular member for coupling to a flowline.

6. The apparatus according to claim 3, wherein:

the pump end member has a pump end face, and the motor end member has a motor end face, the pump end face and the motor end face being within the chamber;

the thrust bearing base is mounted to the motor end face of the motor end member; and the thrust runner is sandwiched between the motor end face and the pump end face.

7. The apparatus according to claim 3, wherein the apparatus is free of any filter devices that would filter the fluid flowing from the intake port to the thrust bearing base.

8. The apparatus according to claim 3, wherein the apparatus is free of any pumping devices that would increase the pressure of the fluid flowing from the intake port to the thrust bearing base.

9. An apparatus for pumping fluid, comprising:

a centrifugal pump having a pump shaft;

a motor having a motor shaft for driving the pump;

a chamber between the pump and the motor, the chamber having a pump end member, a motor end member and a tubular sidewall connecting the end members, the end members having opposed faces and coaxial passages, the pump end member being mounted to a housing of the pump;

a chamber shaft having a pump end within the coaxial passage of the pump end member and coupled to the pump shaft for driving the pump, the coaxial passage in the pump end member being larger in diameter than the diameter of the chamber shaft and defining an annular inlet of the pump surrounding the chamber shaft, the chamber shaft having a motor end extending sealingly through the coaxial passage in the motor end member and coupled to the motor shaft;

a thrust bearing located between the opposed faces of the end members within an interior of the sidewall for absorbing thrust from the pump; and an intake port in the sidewall of the chamber for delivering fluid to the inlet of the pump and to the thrust bearing for lubrication;

wherein the motor end member has an outer portion that is surrounded by and inward from the sidewall, defining an annular clearance in fluid communication with the intake, and wherein the motor end member further comprises:

a port extending from the coaxial passage in the motor end member to the outer portion of the motor end member in fluid communication with the annular clearance for delivering fluid from the intake port to thrust bearing.

* * * * *